United States Patent [19]

Hosoi et al.

[11] Patent Number: 4,607,938

[45] Date of Patent: Aug. 26, 1986

[54] METHOD AND APPARATUS FOR FORMING A THIN LAYER OF DEVELOPER

[75] Inventors: Atsushi Hosoi, Tokyo; Kimio Nakahata, Kawasaki; Hatsuo Tajima, Matsudo; Hidemi Egami, Zama; Fumitaka Kan, Yokohama; Shunji Nakamura, Kawasaki, all of Japan

[73] Assignee: Canon Kabushiki Kaisha, Tokyo, Japan

[21] Appl. No.: 601,715

[22] Filed: Apr. 18, 1984

[30] Foreign Application Priority Data

| | | | |
|---|---|---|---|
| Apr. 26, 1983 | [JP] | Japan | 58-73231 |
| May 10, 1983 | [JP] | Japan | 58-80099 |
| May 10, 1983 | [JP] | Japan | 58-80100 |
| May 10, 1983 | [JP] | Japan | 58-80102 |
| Jun. 14, 1983 | [JP] | Japan | 58-104985 |

[51] Int. Cl.[4] ..... G03G 15/08; G03G 15/09

[52] U.S. Cl. ..... 355/3 DD; 355/14 D; 430/122; 118/657; 118/658

[58] Field of Search ..... 355/3 DD, 14 D, 3 R; 118/657, 658; 430/122

[56] References Cited

U.S. PATENT DOCUMENTS

| | | | |
|---|---|---|---|
| 4,226,525 | 10/1980 | Sakamoto et al. | 355/3 DD X |
| 4,373,798 | 2/1983 | Tsukada et al. | 355/3 DD |
| 4,406,535 | 9/1983 | Sakamoto et al. | 355/3 R |
| 4,435,065 | 3/1984 | Wada | 355/3 DD |
| 4,478,505 | 10/1984 | Tashiro | 355/3 DD |
| 4,491,161 | 1/1985 | Tamura et al. | 355/3 DD X |

*Primary Examiner*—A. C. Prescott

*Attorney, Agent, or Firm*—Fitzpatrick, Cella, Harper & Scinto

[57] ABSTRACT

A developing apparatus for developing a latent image includes a container, a developer carrying member movable along an endless path from inside the container to the outside, a magnetic field generator inside the carrying member, a partition member in the container for separately supporting, before operation, a first developer of magnetic particles and a second developer of non-magnetic particles, and a regulating member cooperable with the magnetic field generator. Upon release of the partition member, the first developer forms a base layer on the carrying member and the second developer forms on the base layer and then, upon circulation of the carrying member the second developer is moved past the regulating member.

42 Claims, 20 Drawing Figures

METHOD AND APPARATUS FOR FORMING A THIN LAYER OF DEVELOPER

BACKGROUND OF THE INVENTION

1. Field of the Invention

The present invention relates to a method and apparatus for forming a thin layer of dry developer, and a developing apparatus using the same.

2. Description of the Prior Art

Conventionally, various types of apparatus have been proposed and put into practice as to a dry type one-component developer apparatus. However, in any of those types, it has been very difficult to form a thin layer of one-component dry developer, so that a relatively thick layer of the developer is used. On the other hand, a recent device for improved sharpness, resolution or the other qualities has necessitated the achievement of a system for forming a thin layer of one-component dry developer.

A method of forming a thin layer of one-component dry developer has been proposed in U.S. Pat. Nos. 4,386,577 and 4,387,664 and this has been put into practice. However, those patents relate to the formation of a thin layer of a magnetic developer, not of a non-magnetic developer. The particles of a magnetic developer must each contain a magnetic material to have magnetic properties. This is disadvantageous since it results in poor image fixing when the developed image is fixed of a transfer material, also in poor reproducibility of color (because on the magnetic material, which is usually black, contained in the developer particles).

Therefore, there has been proposed a method wherein the developer is applied by a cylindrical soft brush made of, for example, beaver fur, or a method wherein the developer is applied by a doctor blade to a developer roller having a textile surface, such as velvet, for formation of a thin non-magnetic developer layer. In the case where the textile brush is used with a resilient material blade, it is possible to regulate the amount of developer applied, but the applied toner layer is not uniform in thickness. Moreover, the blade only rubs the brush so that the developer particles are not charged, resulting in foggy images.

SUMMARY OF THE INVENTION

A primary object of the present invention is to provide a method and apparatus for forming, stably over a long period, a thin layer of dry developer on a developer carrying member and also to provide a developing apparatus using same.

Another object of the present invention is to provide a method and apparatus for easily and effectively forming a base layer including magnetic particles and a developer layer including a developer to form, stably over a long period, a thin layer of dry developer on a developer carrying member and also to provide a developing apparatus using same.

A further object of the present invention is to provide a method and apparatus for forming a thin layer of non-magnetic developer on a developer carrying member by magnetic particles confined within the developer supply container, wherein the magnetic particles are sufficiently circulated in the developer supply container, and also to provide a developing apparatus using same.

A further object of the present invention is to provide a method and apparatus wherein the non-magnetic developer particles are triboelectrically charged to a sufficient extent, and also to provide a developing apparatus using same.

A still further object of the present invention is to provide a method and apparatus using non-magnetic developer particles suitable for color reproduction, and also to provide a developing apparatus using same.

A still further object of the present invention is to provide a method and apparatus using non-magnetic developer particles having better fixativeness, and also to provide a developing apparatus using same.

A further object of the present invention is to provide a developing apparatus wherein the leakage of developer therefrom is prevented.

These and other objects, features and advantages of the present invention will become more apparent upon a consideration of the following description of the preferred embodiment of the present invention taken in conjunction with the accompanying drawings.

BRIEF DESCRIPTION OF THE DRAWINNGS

Figure 12:
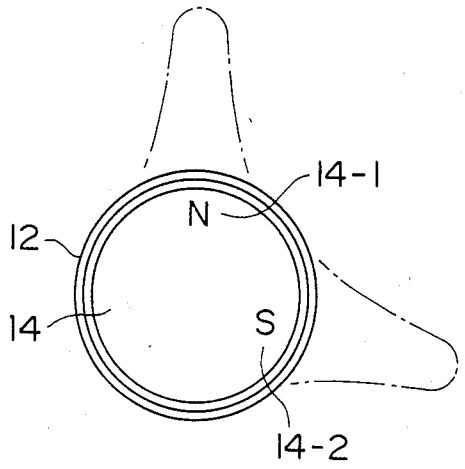
Figure 13:
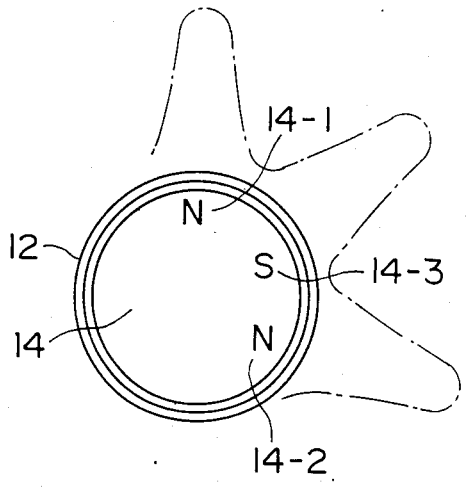

FIGS. 12 and 13 each illustrate by polar coordinates a distribution of magnetic flux density when an embodiment of the present invention is not used.

Figure 14:
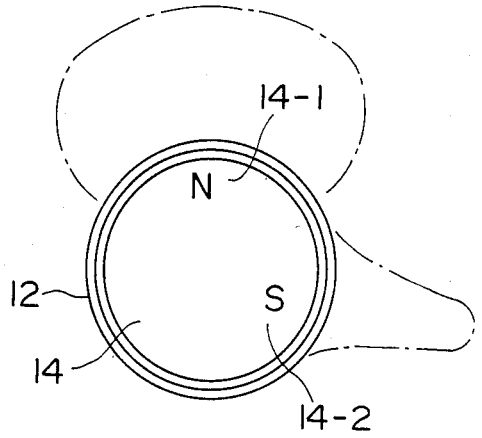

FIG. 14 illustrates by polar coodinates a distribution of magnetic flux density when the present invention is used.

Figure 15:
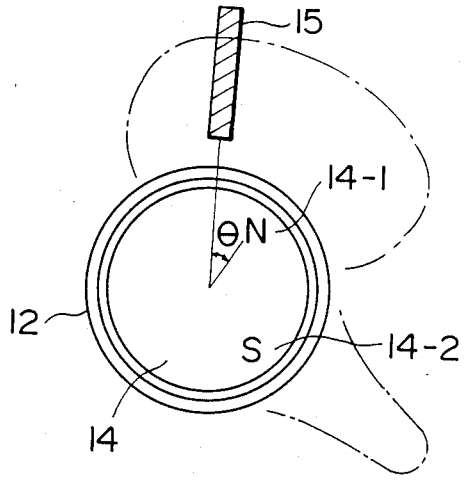

FIG. 15 illustrates by polar coodinates a distribution of magnetic flux density in another example when the present invention is used.

Figure 16:
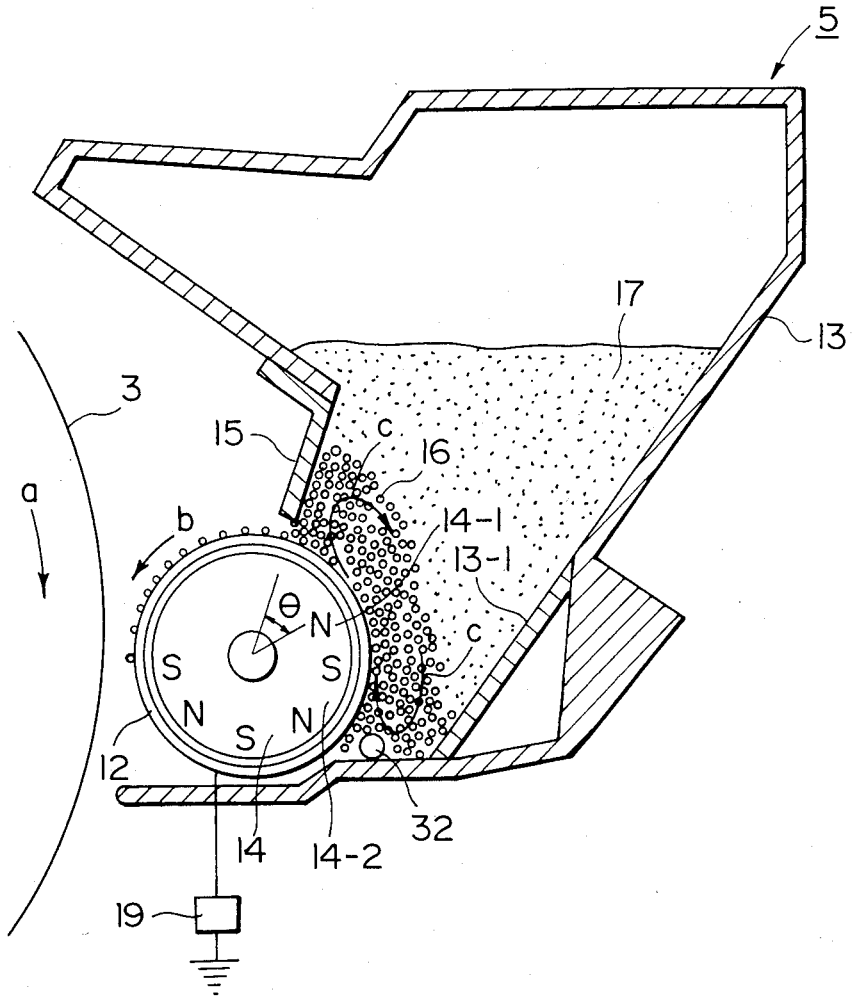

FIG. 16 is a cross-sectional view of a developing apparatus to which the present invention is applicable.

Figure 17:
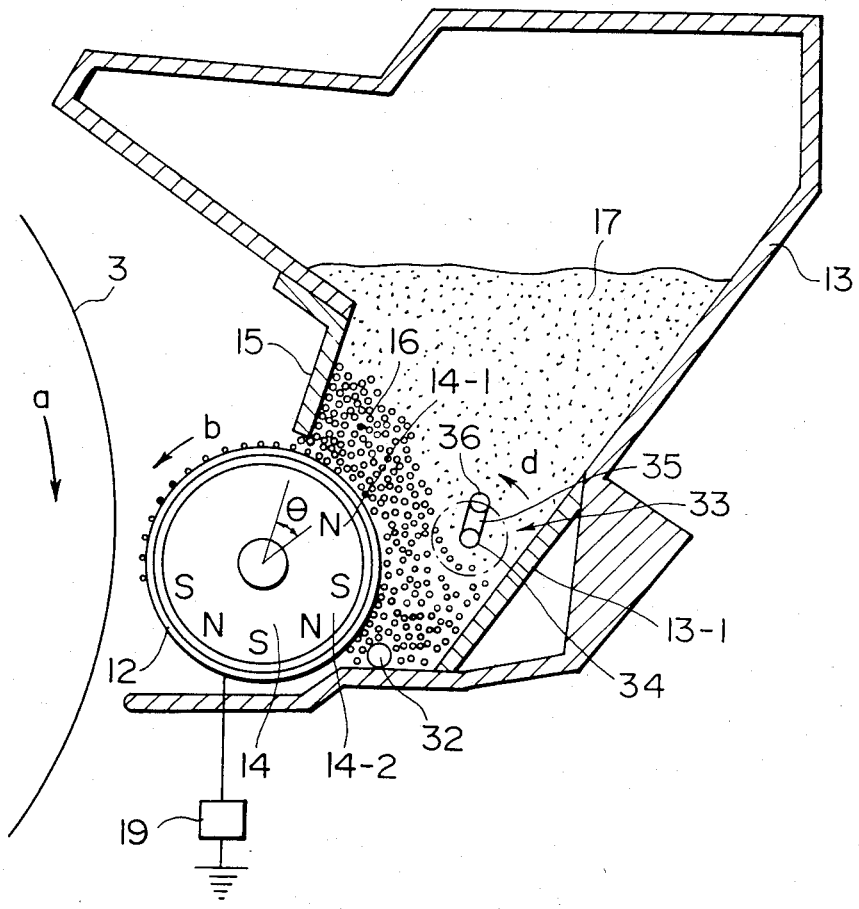

FIG. 17 is a cross-sectional view of a thin layer forming apparatus according to the present invention.

Figure 18:
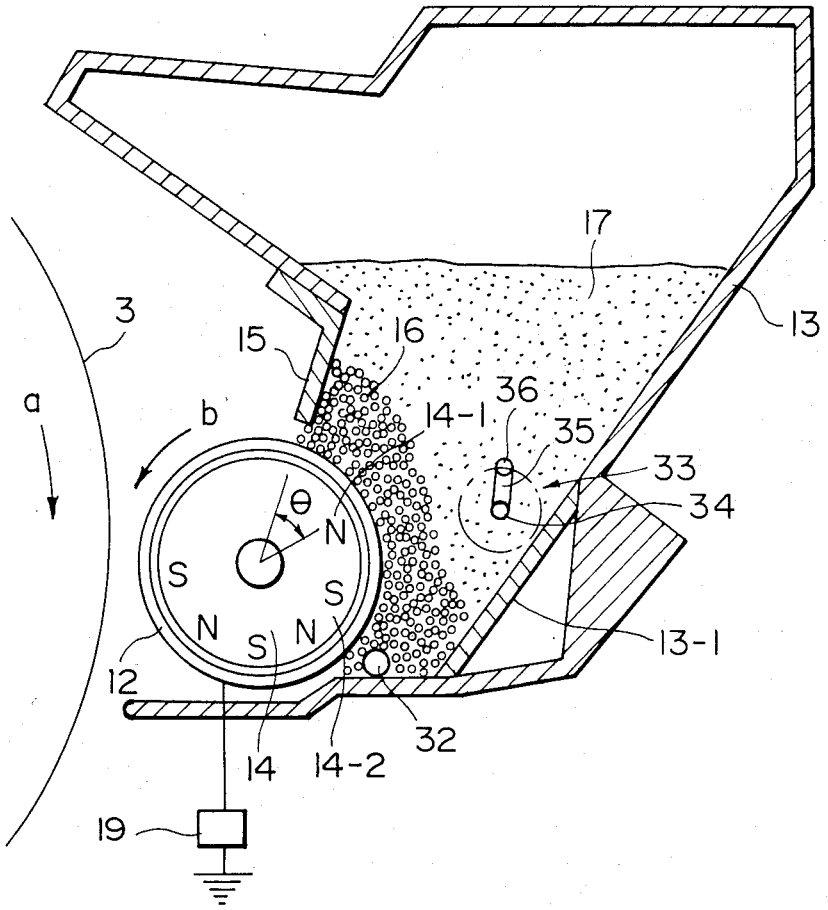

FIG. 18 is a cross-sectional view of a thin layer forming apparatus wherein a position of a stirring means is changed.

Figure 19:
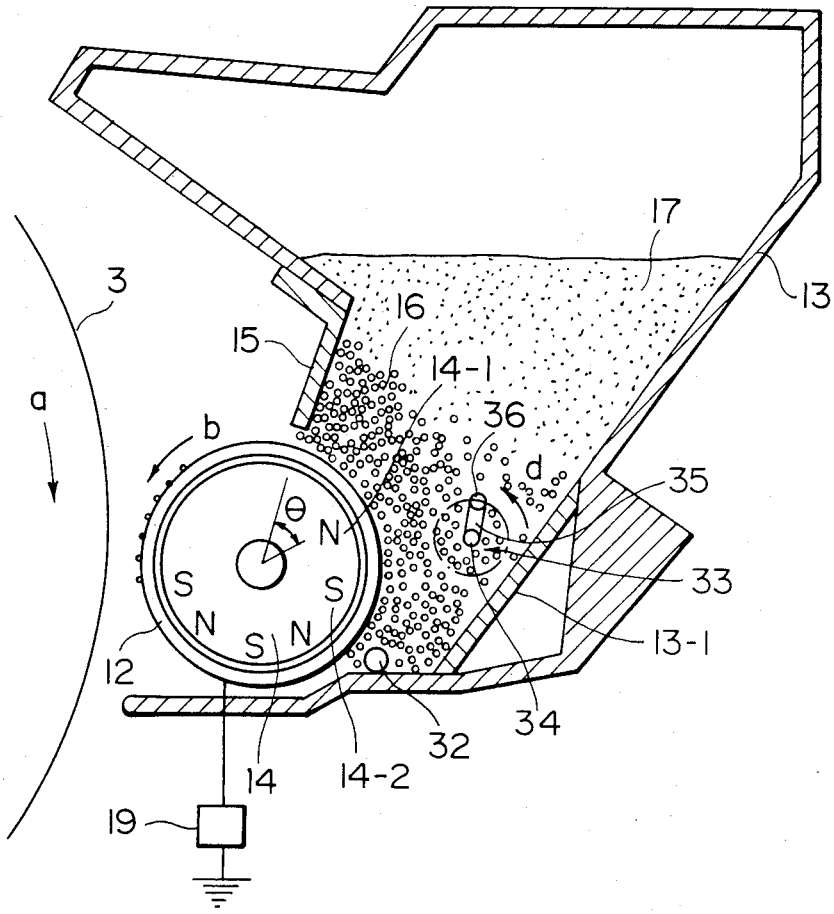

FIG. 19 is a cross-sectional view of a thin layer forming apparatus wherein a position of a stirring means is further changed.

Figure 20:
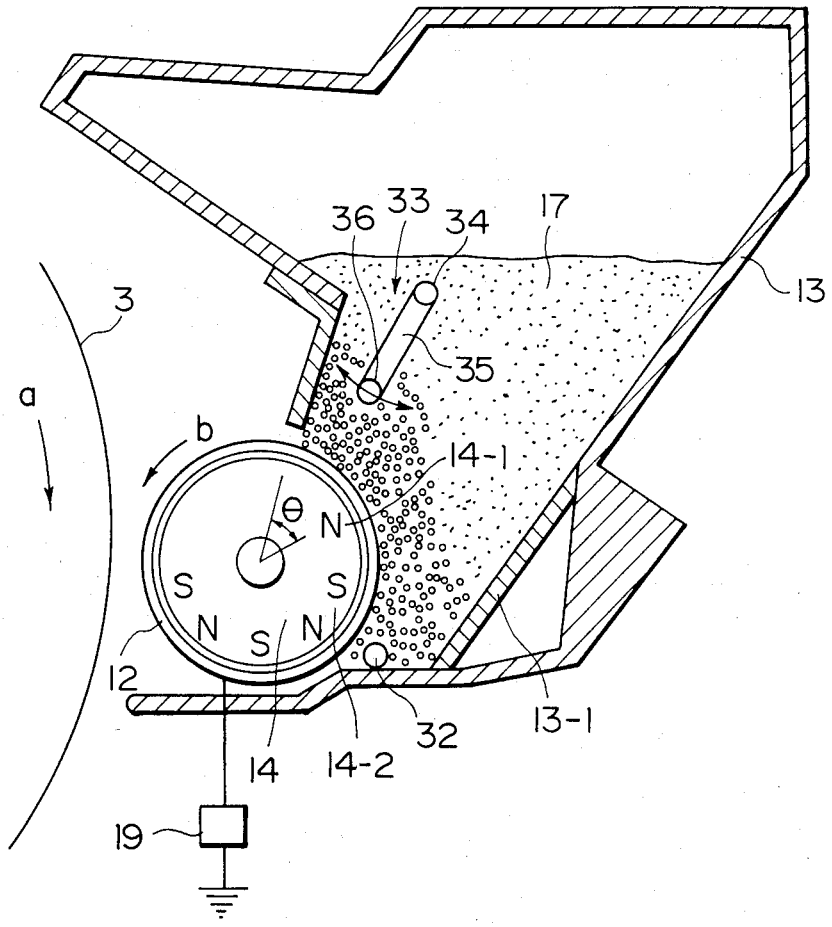

FIG. 20 is a cross-sectional view of a thin layer forming apparatus according to another embodiment of the present invention.

DETAILED DESCRIPTION OF THE PREFERRED EMBODIMENT

The preffered embodiment of the present invention will be described in detail in conjunction with the accompanying drawings.

Figure 1:
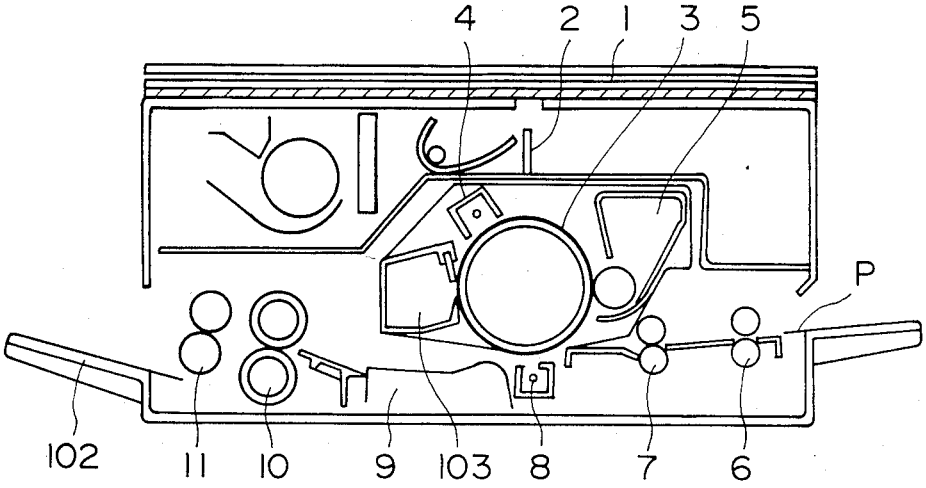
FIG. 1 is a cross-sectional view of an electrophotographic copying apparatus incorporating the thin layer forming device and the developing apparatus according to an embodiment of the present invention.

FIG. 1 is a cross-sectional view of an electrophotographic copying apparatus incorporating the thin layer forming device and the developing apparatus according to an embodiment of the present invention. The copying apparatus is shown as a personal type copying machine which comprises a horizontally reciprocable original carriage having a transparent member, an array 2 of short focus lenses having a small diameter, and a photosensitive member 3 on which an image of the original placed on the original carriage 1 is projected through a slit by the lens array 2. The photosensitive member 3 is shown as a drum, but it may be an endlessly movable web. The photosensitive member 3 is uniformly charged by a charger 4, and then exposed to image light through the lens array 2 so that an electrostatic latent image is formed thereon. The thus formed electrostatic latent image is visualized by the developing apparatus 5 according to the present invention. On the other hand, a transfer material P is fed by a feed roller 6 and a registration roller 7 which feeds the transfer meterial P in timed relation with the image formed on the photosensitive member 3. The visualized image (toner image) on the photosensitive member 3 is then transferred onto the transfer material P by a transfer discharger 8. The transfer material P is separated from the photosensitive member 3, and then conveyed along a guide 9 to an image fixing device 10, whereat the toner image is fixed on the transfer material P. Finally the transfer material is discharged to a tray 102 by a discharging rollers. The photosensitive member 3, the charger 4, the developing apparatus 5 and a cleaning device 103 for removing residual developer from the photosensitive member 3 after image transfer may be constructed as a unit which is mountable into or demountable from the main assembly of the copying apparatus, thus simplifying the maintenance operation.

Figure 2:
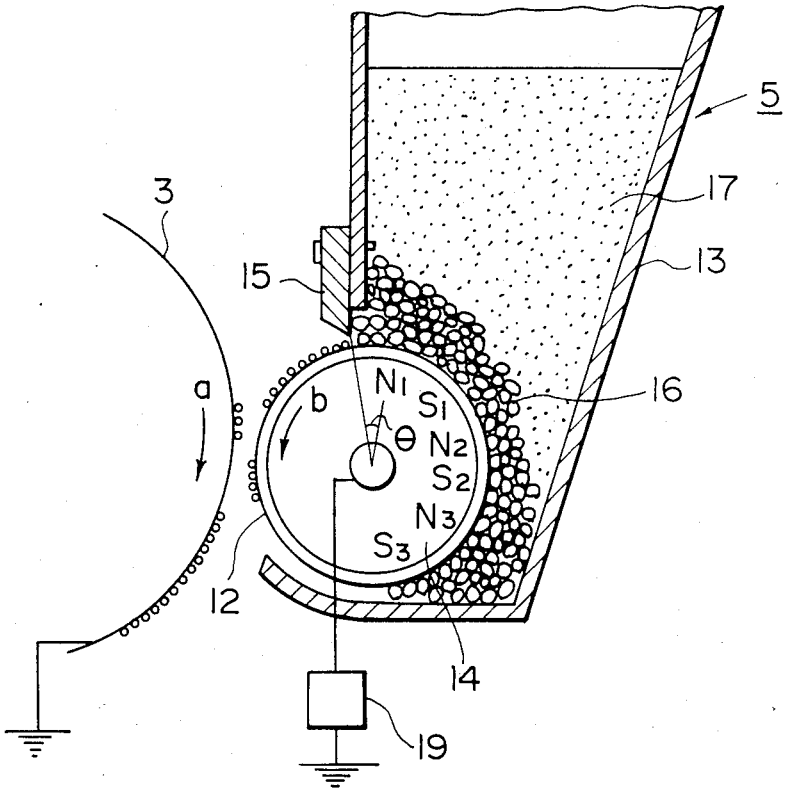
FIG. 2 is a cross-sectional view of a developing apparatus according to an embodiment of the present invention.

FIG. 2 illustrates the method and apparatus according to an embodiment of the present invention, wherein the photosensitive member 3 rotates in the direction of arrow a. Opposed to the surface of the photosensitive member 3 with a gap, a non-magnetic member 12 for carrying a developer is provided. In this embodiment, the developer carrying member 12 is in the form of a cylinder, or more particularly, a sleeve, but it may be an endlessly movable web, as with photosensitive member 3. With the rotation of the photosensitive member 3, the carrying member 12 is rotated in the direction of arrow b. A developer supply container 13 is provided to supply the developer to the carrying member 12. The container 13 is provided with an opening adjacent its lower part. The carrying member 12 is provided in the opening. Since the carrying member 12 is partly exposed outside, the surface thereof moves from the inside of the container 13 to the outside thereof and then back into the container 13. The container 13 has the bottom portion which encloses the carrying member 12 to prevent the developer from leaking out. Inside the carrying member 12, magnetic field generating means, i.e., a magnet 14 in this embodiment, is fixedly supported so that only the carrying member 12 only rotates. The magnet 14 has magnetic poles N1, S1, N2, S2, N3 and S3.

In the neighbourhood of the upper part of the container 13, a confining member 15, as magnetic particle confining means, is provided to confine within the container 13 magnetic particles which will be described hereinafter. The confining member 15 is of a magnetic material in this embodiment. Across the carrying member 12 from the confining member 15 there is a magnetic pole N1 of the magnet 14. However, the magnetic pole N1 is not right across but is displaced by a predetermined angle $\theta$ (5–50 degrees) toward upstream with respect to the direction of the movement of the carrying member 12.

Into the container 13 of the above-described structure, magnetic particles or a mixture of magnetic particles and non-magnetic developer particles are supplied so that a base layer 16 is formed. The mixture constituting the base layer 16 preferably contains 5–70 wt. % of non-magnetic developer, but may only have magnetic particles. The particle diameter of the magnetic particle is 30–200, preferably 70–150, microns. Each of the magnetic particles may consist of a magnetic material or may consist of a magnetic material and non-magnetic material. The magnetic particles in the base layer 16 are formed into a magnetic brush by the magnetic field provided by the magnet 14, which brush is effective to perform a circulation which will be described in detail hereinafter. A magnetic brush is also formed between the magnetic pole N1 and the magnetic particle confining member 15, which is effective to constrain the magnetic particles of the base layer 16 within the container 13.

Above the base layer 16, non-magnetic developer particles are supplied to form a developer layer 17, so that two layers are formed generally horizontally in the container 13. The non-magnetic developer supplied may contain a small amount of magnetic particles, but even in that case, the magnetic particle content of the developer layer 17 is smaller than that of the base layer 16. To the non-magnetic developer particles, silica particles for enhancing the flowability and/or abrasive particles for effectively abrading the surface of the photosensitive member 3 may be added.

The formation of the two layers is not limited to this manner, i.e., two materials are supplied separately, but may be made, for example, by supplying a uniform mixture of the magnetic particles and non-magnetic developer containing the sufficient amount of respective materials for the entire base layer 16 and developer layer 17, and then vibrating the container 13 to form the two layers, using the magnetic field of the magnet 14 and the difference in the specific gravity between the two materials.

Figure 3:
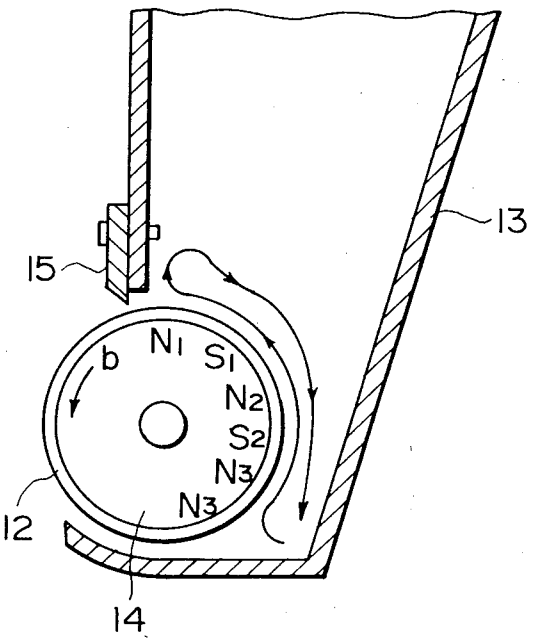
FIG. 3 is a cross-sectional view of a developing apparatus according to an embodiment of the present invention showing the flow in the base layer.

After the two layers are formed as described above, the carrying member 12 is rotated. The magnetic particles are circulated by the magnetic field provided by the magnetic poles and gravity, as shown in FIG. 3. More particularly in the neighbourhood of the surface of the non-magnetic developer carrying member 12 near the bottom of the container 13, the magnetic particles move upwardly along the surface of the carrying member 12 by the cooperation of the magnetic field of the magnet 14 and the rotation of the carrying memb 12. During this movement, the non-magnetic developer particles contact the carrying member 12 surface so the non-magnetic developer contained in the layer 16 is coated on the carrying member 12 surface electrostatically.

In this embodiment of the present invention, the non-magnetic developer is triboelectrically charged by the contact with the magnetic particles and with the carrying member 12. Preferably, however, the triboelectric charge with the magnetic particles is reduced by treating the surface of the magnetic particles with an insulating material, such as oxide coating and a resin having the same electrostatic level as the non-magnetic developer, so that the necessary charging is effected by the contact with the carrying member 12 surface. Then, the deterioration of the magnetic particles is prevented, and simultaneously, the non-magnetic developer is stably coated on the carrying member 12.

The magnetic particles are moved upwardly too by the rotation of the carrying member 12, but prevented from passing through the clearance between the tip of the magnetic particle confining member 15 and the carrying member 12 by the magnetic field formed between the confining member 15 and magnetic pole N1. The magnetic particles behind the confining member 15 within the container 13 are urged by the magnetic particles fed continuously from the bottom of the container 13, and turn, as shown in FIG. 3, whereafter they slowly move down under gravity. During this downward movement, the magnetic particles take the non-magnetic developer particles among themselves from the lower part of the developer layer 17. Then, the magnetic particles return to the bottom part of the container 13, and those actions are repeated.

On the other hand, the triboelectrically charged non-magnetic developer particles, which are non-magnetic, are not limited by the magnetic field existing in the clearance between the tip of the confining member 15 and the surface of the carrying member 12, so that they are allowed to pass there, and they are coated as a thin layer of uniform thickness on the carrying member 12 by the magnetic brush formed at the confining member 15 and by the image force. The thin layer of the non-magnetic developer is thus conveyed out of the container 13, and moved to the developing station, where the thin layer is opposed to the photosensitive member 3 to develop a latent image thereon.

The developing system to be used here is preferably the non-contact type development disclosed in U.S. Pat. No. 4,395,476, although conventional contact type development is usable. Between the photosensitive member 3 and the carrying member 12, a voltage is applied by a bias voltage source 19 which is of AC, DC or preferably an AC superposed with a DC.

The developer to be consumed for the development is supplied from the base layer 16, and the consumption of the developer in the base layer 16 is compensated from the developer layer 17 during the above-described circulation.

Since the base layer 16 is formed around the carrying member 12 from the beginning, and since the developer layer 17 does not contain the magnetic particles, or if any, it contains only a small amount to compensate the unavoidably lost magnetic particles, the state of the magnetic brush formed in the base layer 16 is maintained constant over a long run of the device. In this sense, the magnetic particles within the base layer 16 is a part of the developing or thin layer forming apparatus, rather than a developer or a part of a developer.

It is preferable that the surface of the carrying member 12 contacts only the base layer 16 and does not directly contact the developer layer 17 so that the conveying force of the carrying member 12 is not transmitted to the developer to maintain constant the developer content of the base layer 16, irrespective of the amount of the non-magnetic developer in the developer layer 17.

The thickness of the base layer 16 is preferably determined in consideration of the circulation and the taking of the non-magnetic developer. More particularly, since the upper part of the base layer 16 is to be effective to take the developer in so that it preferably moves as shown in FIG. 3 by the arrow. If it is too thick, the upper part which contacts the non-magnetic developer does not move, resulting in insufficient taking of the non-magnetic developer.

Satisfactory results were shown using the above-described present invention and with the following detailed structures.

The base layer 16: Spherical magnetic particles of 80–105 microns containing non-magnetic developer of average diameter of 10 microns (35% by weight to the magnetic particles):

The non-magnetic developer later 17: Non-magnetic developer only, same material as with the developer contained in the base layer 16:

(The same structure as above, with the exception of a small amount of the magnetic particles (2–5%) added to the non-magnetic developer also showed good results.)

The thin layer of the non-magnetic developer obtained by the above structure was opposed to a photosensitive member 3 bearing an electrostatic latent image of −500 V at the dark area and −150 V at the light area with the clearance of 300 microns to the surface of the photosensitive member 3. The bias voltage of 1.6 KHz and peak-to-peak voltage of 1.5 KV with central value of −250 V was applied by the bias source 19. A PC-20 copying machine (Canon Kabushiki Kaisha, Japan) was used, and good resultant images without ghost or fog were obtained.

Further, until 2000 copies were formed, that is, until most of the non-magnetic developer has been consumed, there was no variation of the image density leakage of the magnetic particles reached the developing station.

Figure 4:
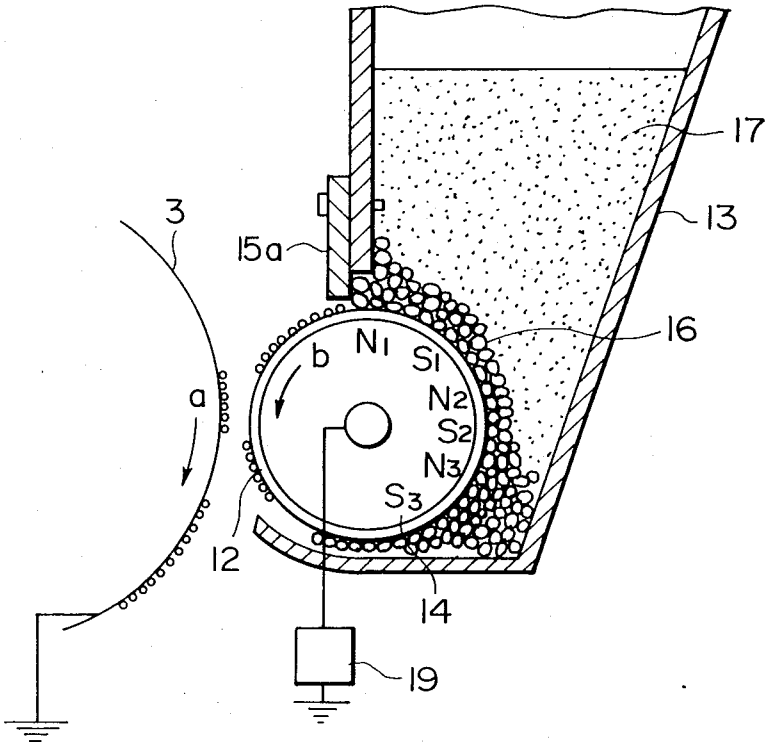
FIG. 4 is a cross-sectional view of a developing apparatus according to another embodiment of the present invention.

FIG. 4 shows another embodiment of the present invention. Since this embodiment is similar to the foregoing embodiment, except for the portions which will be described, the detailed description is omitted for the sake of simplicity by assigning the same reference numerals to the elements having corresponding functions. In this embodiment, a non-magnetic blade **15*a* is used in place of the confining member 15** of the foregoing embodiment.

As described above, according to the present invention, the magnetic brush functioning to take the non-magnetic developer and to form a thin layer of the non-magnetic developer on the carrying member 12, is maintained for a long period of time, so that a stabilized thin layer is formed, thus providing a good developing operation for a long period of time.

Figure 5:
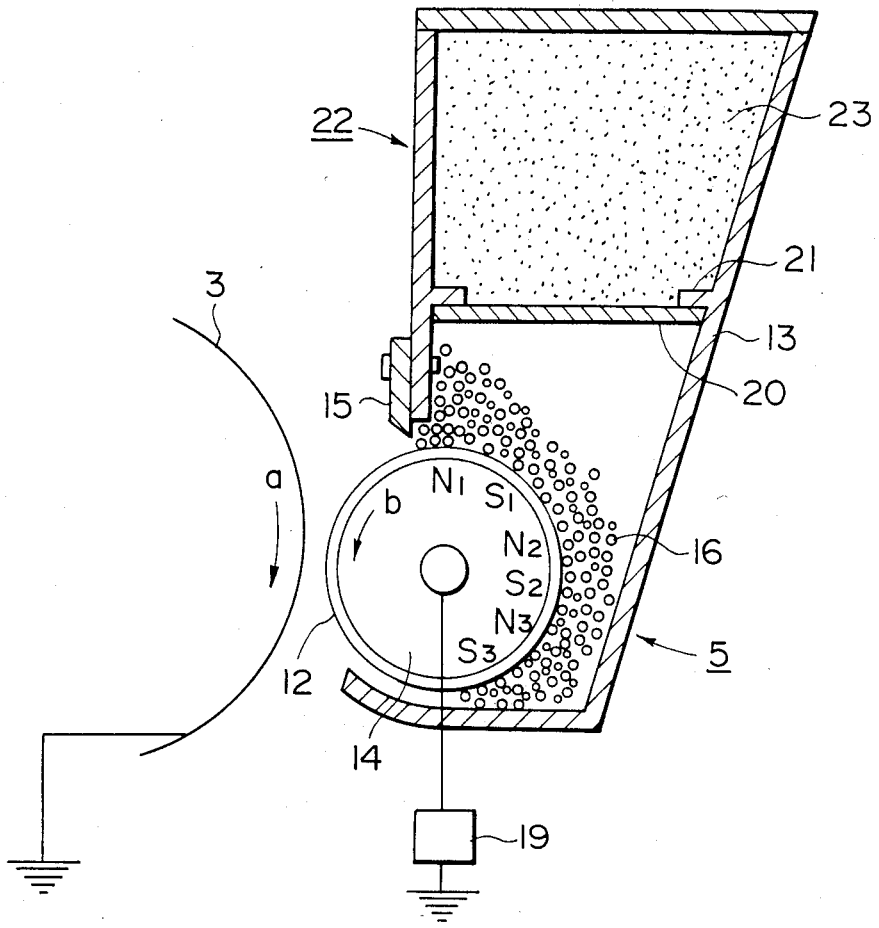
FIG. 5 is a cross-sectional view of a developing apparatus according to yet another embodiment of the present invention, having a partition plate.

FIG. 5 shows an embodiment of the structure for supplying the non-magnetic developer. Since this embodiment is similar to the embodiment described with FIG. 2, except for the portions which will be described, the detailed description is omitted for the sake of simplicity by assigning the same reference numerals to the elements having corresponding functions. In FIG. 5, around the surface of the carrying member 12, a base layer 16 of magnetic particles is formed by the magnet 14. The base layer 16 consists of magnetic particles or of the mixture of magnetic particles and non-magnetic developer particles.

At the upper part of the container 13, there is provided a partition plate 20 which is bonded by heat-seal or the like to a sheet guide 21 to divide the space into one thereabove and one therebelow. The upper space constitutes a developer accommodation and contains the non-magnetic developer 23 which in use forms a developer layer 17. Thus, the non-magnetic developer 23 is accommodated without contact with or without being mixed with the magnetic particles for the base layer 16. The non-magnetic developer 23 may be mixed with a small amount of magnetic particles, but in that case, the magnetic particle content thereof is less than that of the magnetic particle accommodating portion. To the non-magnetic developer particles, silica particles for enhancing the flowability and/or abrasive particles for effectively abrading the surface of the photosensitive member 3 may be added.

When the developing apparatus according to this embodiment is to be put into use, the partition plate 20 is drawn out laterally (in the direction parpendicular to the sheet of the drawing). Then, non-magnetic developer 23 contained in the space above the partition plate 20, falls on the base layer 16, so that the two layers, i.e., the base layer 16 and the developer layer 17 is formed, and the developing apparatus becomes usable. The developing apparatus is now usable as it is, if the base layer 16 has a proper amount of non-magnetic developer particles beforehand. If not, that is, the base layer 16 contains magnetic particles only, the carrying member 12 is rotated idly, until a proper amount of the non-magnetic developer is mixed into the base layer 16 by the circulation of the magnetic brush.

When the non-magnetic developer 23 falls on the base layer 16, it does not leak through the clearance between the container 13 and the carrying member 12 so that it does not scatter out, since the base layer 16 already formed seals the clearances.

After the two layers are formed as described above, carrying member 12 is rotated. The magnetic particles are circulated by the magnetic field provided by the magnetic poles and gravity, as shown in FIG. 3. Similarly to the foregoing embodiment, only the non-magnetic developer is coated on the carrying member 12 and conveyed to the developing station. The detailed example of the device is same as with respect to FIG. 2.

Figure 6:
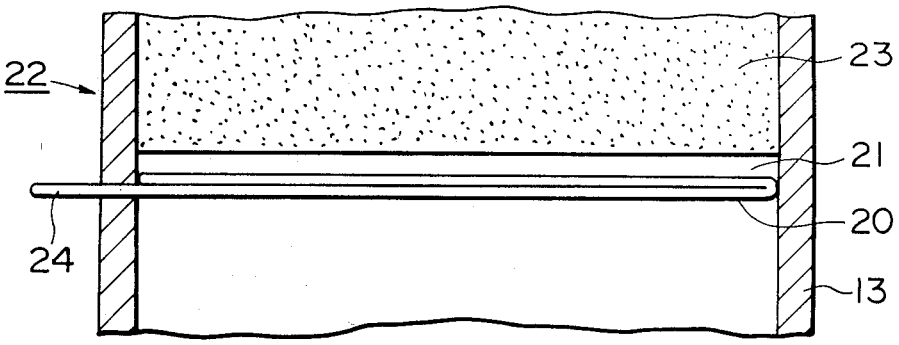
FIG. 6 shows another partition plate.

FIG. 6 shows another embodiment of the partition plate of the developer accommodating portion 22. The partition plate 20 has an end which projects out of the container 13, and extends therefrom into the container 13 as far as it abuts the inside of the opposite wall of the container 13, where it is turned 180 degrees to form a two layer structure. The upper part of the two layer structure is bonded by heat-seal or the like to the sheet guide 21. Because of this structure, the partition plate is easily removed simply by pulling the projecting end.

In the embodiments shown in FIGS. 5 and 6, the non-magnetic developer 23 is accommodated at a fixed position of the container 13. However, it may be accommodated in a exchangeable cartridge.

As described above, according to the FIG. 5 and 6 embodiments of the present invention, the container 13 has, at its upper portion, the developer accommodating portion which can contain the non-magnetic developer without contact with the base layer 16, and therefore, the two layers can be positively formed simply by causing the non-magnetic developer to fall onto the base layer 16, where the base layer 16 is already formed before the non-magnetic developer 23 falls so that the non-magnetic developer does not scatter around.

As described above, according to the present invention the magnetic brush functioning to take the non-magnetic developer and to form a thin layer of the non-magnetic developer on the carrying member 12, is maintained for a long period of time, so that a stabilized thin layer is formed, thus providing a good developing operation for a long period of time.

Figure 7:
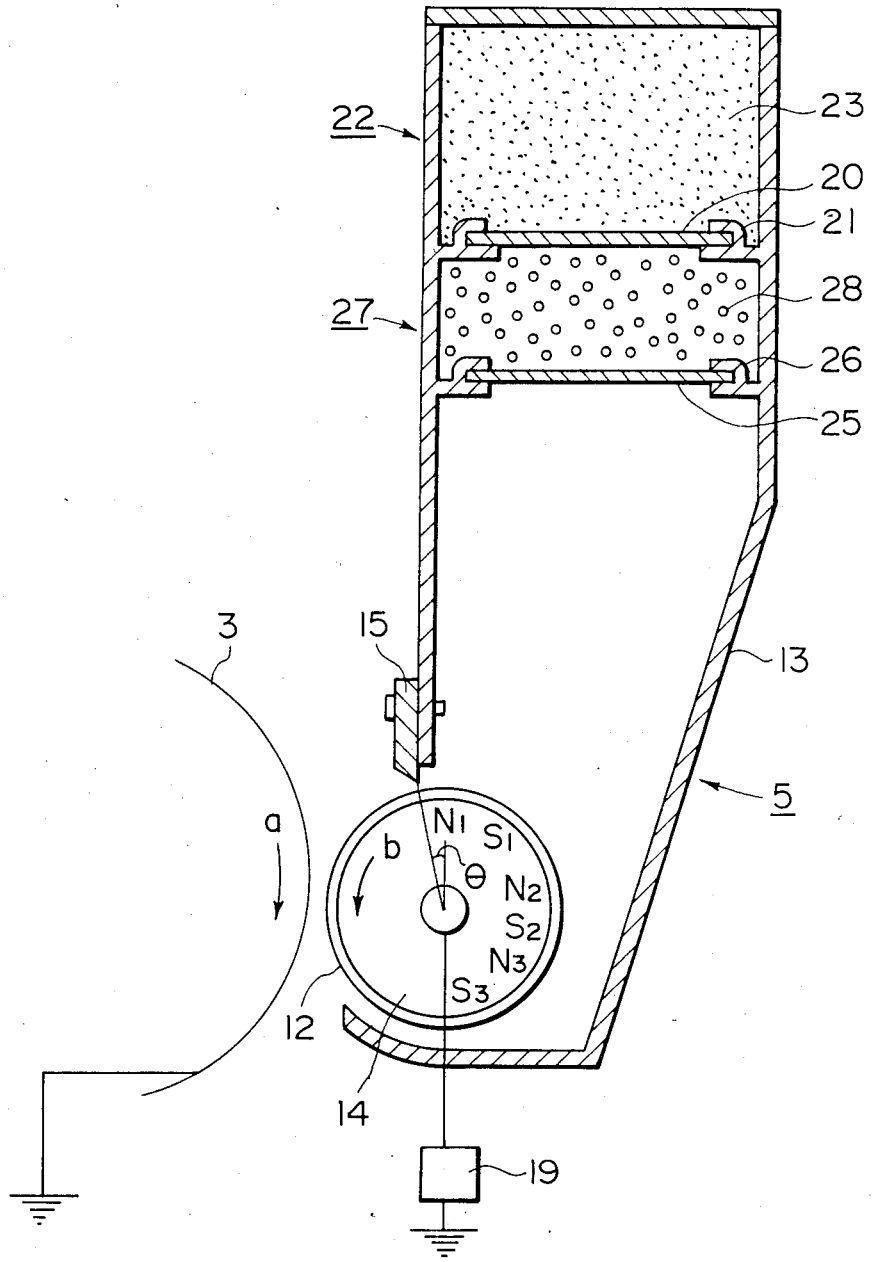
FIG. 7 is a cross-sectional view of a developing apparatus according to an embodiment of the present invention before use.

FIG. 7 shows another embodiment of the present invention. Since this embodiment is similar to the embodiment described with FIGS. 2 and 5, except for the portions which will be described, the detailed description is omitted for the sake of simplicity by assigning the same reference numerals to the elements having corresponding functions.

In FIG. 7, adjacent to the upper part of the container 13, the confining member 15, as magnetic particle confining means, is provided. The confining member 15 is of a magnetic material. Across the carrying member 12 from the confining member 15 there is a magnetic pole N1 of the magnet 14. However, the magnetic pole N1 is not right across but is displaced by a predetermined angle $\theta$ (5–50 degrees) toward upstream with respect to the direction of the movement of the carrying member 12.

At the upper part of the container 13, there is provided a first partition plate 25 which is bonded by heat-seal or the like to the first sheet guide 26 to divide the space into the one thereabove and the one therebelow. The upper space provides the accommodation 27 for the magnetic particles. The magnetic particles 28 contained therein may include magnetic particles only or may be a mixture of the magnetic particles and non-magnetic developer particles. The mixture containing 5–70 wt. % of the magnetic particles is preferable. The particle diameter of the magnetic particle is 30–200, preferably 70–150, microns. Each of the magnetic particles may consist of a magnetic material or may consist of a magnetic material and non-magnetic material.

Above the first partition plate 25, there is a second partition plate 20, which is bonded by heat-seal or the like to a second sheet guide 21, similarly to the first partition plate 25, to define thereabove a store of non-maghetic developer 23. Thus, the non-magnetic developer 23 is accommodated without contact or mixing with the magnetic particles 28. To the non-magnetic developer particles, silica particle for enhancing the flowability and/or abrasive particles for effectively abrading the surface of the photosensitive member 3 may be added. Also, a small amount of magnetic particles may be added to the developer.

In use, the first partition plate is first pulled out laterally (in the direction perpendicular to the sheet of the drawing) to allow the magnetic particles 28 to fall on the carrying member 12. The magnetic particles are then formed into a base layer 16 by the magnet 14 (FIG. 2). The magnetic particles in the base layer 16 are formed into a magnetic brush by the magnetic field provided by the magnet 14. The magnetic brush effects the above-described circulation. A magnetic brush is also formed between the confining member 15 and the magnetic pole N1, which is effective to retain the magnetic particles within the container 13.

Next, the second partition plate 20 is drawn out, then the non-magnetic developer thereabove falls on the base layer 16, so that generally two layers, i.e., the base layer 16 and the developer layer 17 are formed, whereby the developing apparatus becomes usable. The developing apparatus is now usable as it is, if the base layer 16 has a proper amount of non-magnetic developer particles beforehand. If not, that is, the base layer 16 contained magnetic particles only, the carrying member 12 is rotated idly, until a proper amount of the non-magnetic developer is mixed into the base layer 16 by the circulation of the magnetic brush. When the non-magnetic developer 23 falls on the base layer 16, it does not leak through the clearance between the container 13 and the carrying member 12 so that it does not scatter out, since the base layer 16 already formed seals the clearances. Returning to the falling of the magnetic particles, the developer contained therein do not practically scatter when they fall, since no or only a small amount of developer is contained therein. However, in order to positively prevent the scattering, some magnetic particles are given at the inlet and outlet of the container 13 to seal there. The magnetic particles for this seal may be the same as those contained in the accommodation 28.

After the two layers are formed as described above, carrying member 12 is rotated. The magnetic particles are circulated by the magnetic field provided by the magnetic pole and gravity, as shown in FIG. 3. Similarly to the foregoing embodiment, only the non-magnetic developer is coated on the developer carrying member 12 and conveyed to the developing station. The detailed structure of the device is the same as with respect to FIGS. 2 and 5.

Satisfactory results were obtained using the above-described present invention and with the following detailed structures.

The base layer 16: Spherical magnetic particles of 80–105 microns containing non-magnetic developer of average diameter of 10 microns (35% by weight to the magnetic particles):

The non-magnetic developer layer 17: Non-magnetic developer only, same material as with the developer contained in the base layer 16:

(The same structure with the exception of a small amount of the magnetic particles (2–5%) added to the non-magnetic developer showed good results.)

The thin layer of the non-magnetic developer obtained by the above structure is opposed to a photosensitive member 3 bearing an electrostatic latent image of −500 V at the dark area and −250 V at the light area with the clearance of 300 microns to the surface of the photosensitive member 3. The bias voltage of 1.6 KHz and peak-to-peak voltage of 1.3 KV with central value of −250 V is applied by the bias source 19. A PC-20 copying machine(Canon Kabushiki Kaisha, Japan) is used, and good resultant images without ghost or fog were obtained.

Further, until 2000 copies are formed, that is, until most of the non-magnetic developer has been consumed, there was no variation of the image density and no leakage of the magnetic particles reached the developing station.

Figure 8:
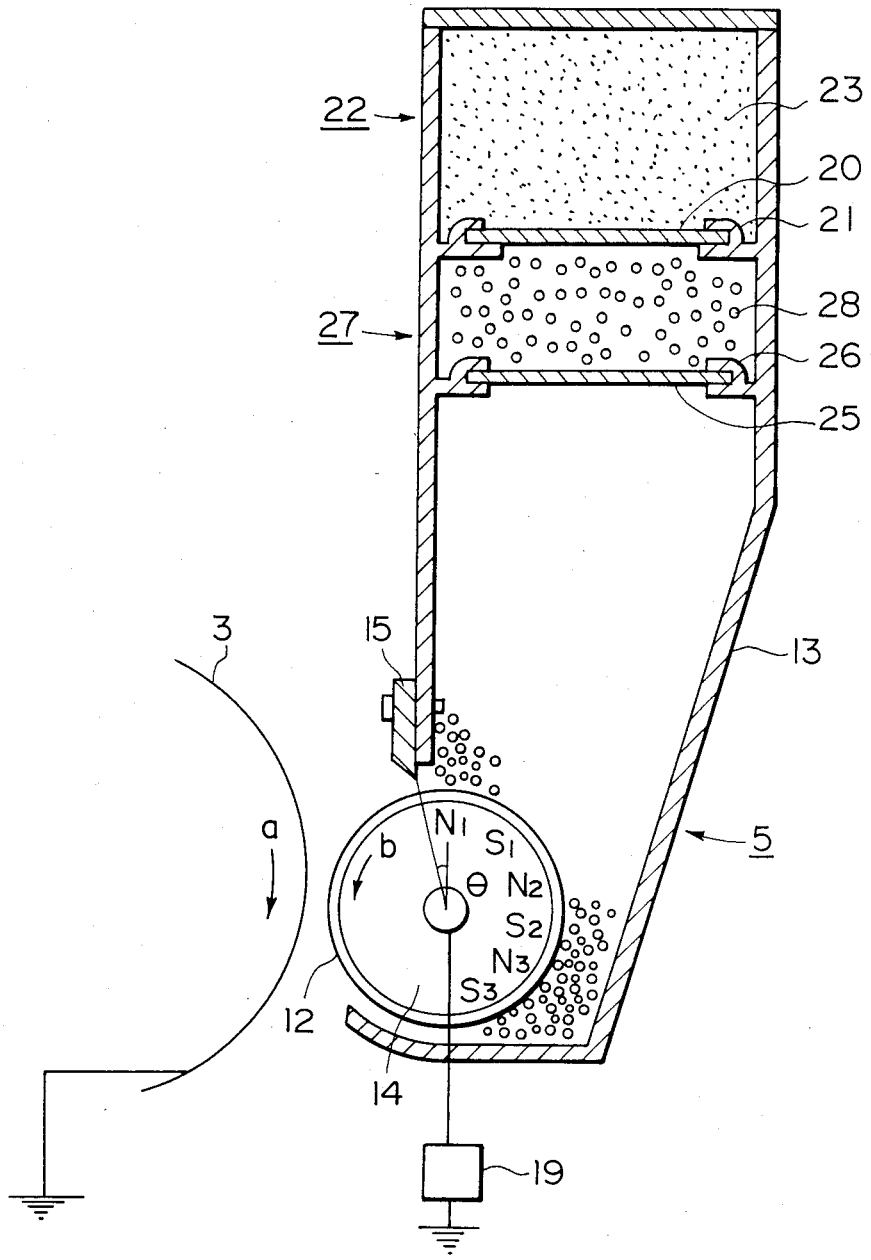
FIG. 8 is a cross-sectional view of a developing apparatus according to another embodiment of the present invention before use.

In these embodiments, a confining member 15 of a magnetic material, that is, a magnetic blade has been used as shown in FIG. 8, but a non-magnetic blade may be used.

Figure 9:
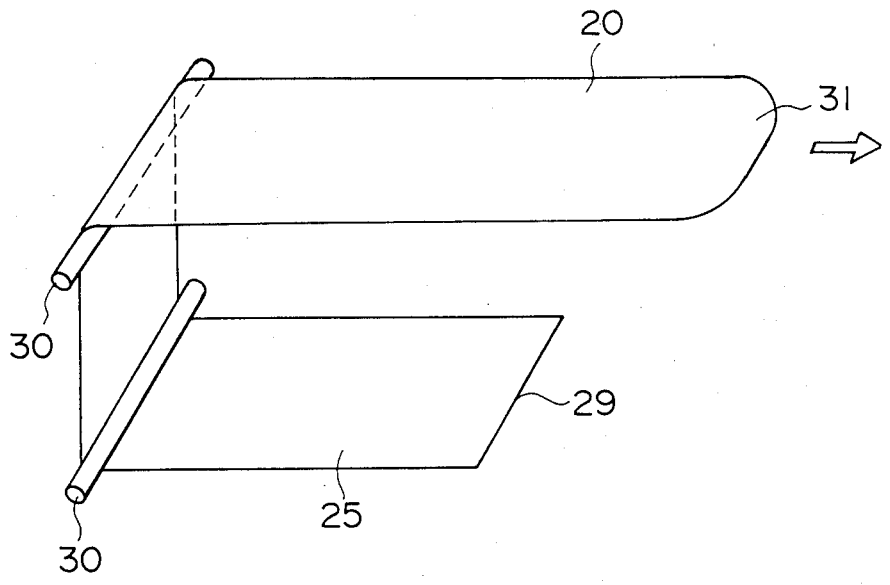
FIG. 9 is a cross-sectional view of a partition plate according to another embodiment of the present invention.

FIG. 9 shows another example of the partition plate, wherein the partition plate has an end 29 within the container 13, from which it extends within the container 13 leftwardly, as viewed in the drawing. The upper part thereof is bonded to the upper sheet guide 26 by heat-seal or the like to constitute a first partition plate 25. The partition plate 25 further extends out of the container 13, and then guided by a guiding roll 30 to extend upwardly, thereafter guided by another roll 30 to extend back into the container 13. The guiding rolls make the pulling of the partition plate easier. The partition plate coming back into the container 13 constitutes a second partition plate 20. Here, again, the upper part of the second partition plate 20 is boned to an upper sheet guide 28 by heat-seal or the like. Then, the partition plate extends out again to provide a pulling end 31. Thus, the first partition plate 25 and the second partition plate 20 are integral with each other. To make the developing apparatus ready for use, the pulling end 31 is pulled. Then, the first partition plate 25 is first removed from its place, thereafter, the second partition plate 20 is removed simply by continuing to pull it. Therefore, the first and second partition plates 25 and 20 are removed in the designed order by a single action, so it is convenient.

Figure 10:
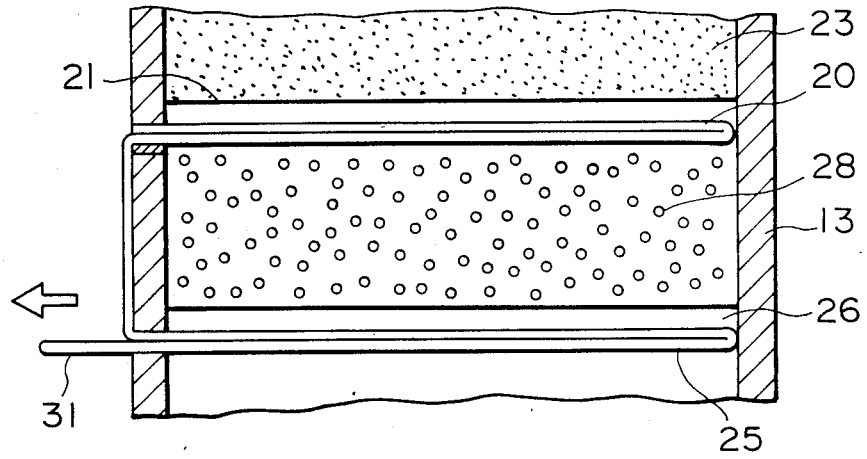
FIG. 10 is a cross-sectional view of a partition plate according to a further embodiment of the present invention.

FIG. 10 shows a further example of the partition plate. The partition plate has an end extending out of the container 13, from which the partition plate extends into the container 13 and reversed at the inside of the opposite wall of the container 13, and extends back, thus constituting a two layer structure. The upper part of the two layer structure is bonded to an upper guide by heat-seal or the like to constitute a first partition plate 25. The partition plate member extends out of the container 13, and extends upwardly, and goes into the container 13, again. The partition plate reverses after it abuts the inside of the opposite wall of the container 13 to provide another two layer structure, thus constituting a second partition plate 20. Here, again, the upper part of the two layer structure is bonded by heat-seal or the like to its upper sheet guide 21. In this example too, the first and second partition plates 25 and 20 are integral with each other. To make the developing apparatus ready for use, the pulling end 31 is pulled. Then, the first partition plate 25 is first removed from its place, thereafter, the second partition plate 20 is removed simply by continuing to pull it. Therefore, the first and second partition plates 25 and 20 are removed in the designed order by a single action so that it is convenient. These are the same as with respect to the foregoing example, but, in addition, this example is further advantageous since the partition plate is more easily peeled off.

In the embodiments and examples described in the foregoing paragraphs, the non-magnetic developer 23 and the magnetic particles are accommodated at fixed positions of the container 13. However, they may be accommodated in exchageable cartridges.

As described above, according to the FIGS. 7 to 10 embodiments of the present invention, two layers can be positively formed simply by causing the the magnetic particles and non-magnetic developer to fall into the container 13. In addition, since the base layer 16 is already formed before the non-magnetic developer 23 falls so that the non-magnetic developer does not scatter around. Further, the magnetic brush functioning to take the non-magnetic developer and to form a thin layer of the non-magnetic developer on the carrying member 12, is maintained for a long period of time, so that a stabilized thin layer is formed, thus providing a good developing operation for a long period of time.

In the operation of the developing apparatus and method which have been described, it is preferable that the magnetic particles circulate within the container 13.

Figure 11:
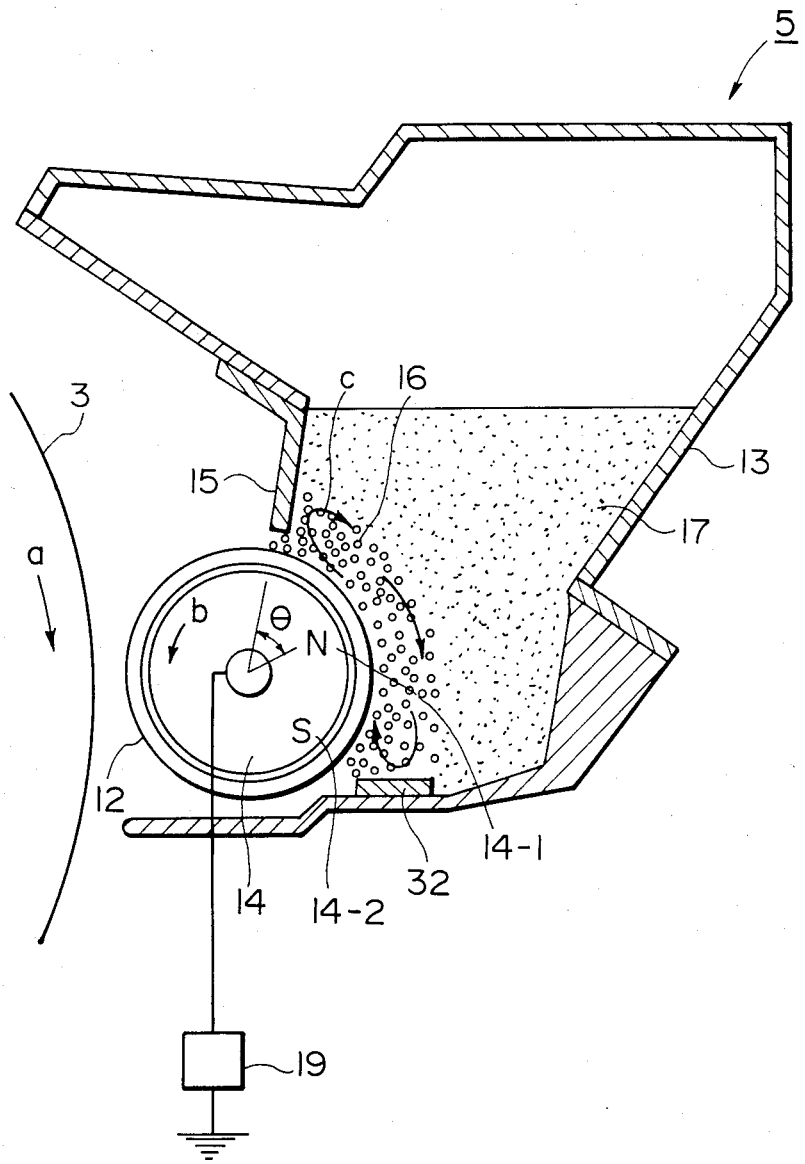
FIG. 11 is a cross-sectional view of a developing apparatus embodying the method of the present invention.

FIG. 11 shows another embodiment of the thin layer forming method and apparatus and developing method and apparatus. Since this embodiment is similar to the embodiment described with FIGS. 1 to 10, except for the portions which will be described, the detailed description of the similar parts is omitted for the sake of simplicity by assigning the same reference numerals to the elements having corresponding functions.

Inside the carrying member 12, magnetic field generating means, i.e., a magnet 14 in, this embodiment, is fixedly supported so that only the carrying member 12 rotates in the direction shown by arrow b. The magnet 14 has magnetic particle confining pole 14-1(N) and magnetic particle ladling pole 14-2(S). On a part of the inside wall of the container 13, which is opposed to the magnetic particle ladling pole 14-2 an iron piece 32 is secured, which may be another metal or a magnet having the magnetic pole of the polarity opposite to that of the magnetic particle ladling pole 14-2. In place of using a separate member, as the piece, the same effect may be provided by simply approaching the part of the container 13 wall toward the carrying member 12 at the portion opposed to the magnetic particle ladling pole 14-2, when the container 13 wall is made of a magnetic material such as steel.

In the neighbourhood of the upper part of the container 13, a confining member 15, as magnetic particle confining means, is provided. Across the carrying member 12 from the confining member 15, there is the magnetic particle confining pole 14-1 of the magnet 14. However, the magnetic particle confining pole 14-1 is not right across but is displaced by a predetermined angle $\theta$ (5–50 degrees) toward upstream with respect to the direction of the movement of the carrying member 12. The confining member 15 may be a blade of a magnetic material such as a steel, or non-magnetic material such as aluminium, copper and resin, or it may be a part of the container 13 wall of the same material.

Into the container 13 of the above-described structure, magnetic particles or a mixture of magnetic particles and non-magnetic developer particles are supplied so that a base layer 16 is formed. The mixture constituting the base layer 16 preferably contains 5–70 wt. % of non-magnetic developer, but may only have magnetic particles. As for the magnetic particle, iron powder, ferrite or the mixture thereof may be used. The particle diameter of the magnetic particle is 30–200, preferably 70–150, microns. Each of the magnetic particle may consist of a magnetic material or may consist of a magnetic material and non-magnetic material. The magnetic particles in the base layer 16 are formed, by the magnetic field provided by the magnet 14, into a magnetic brush, which is effective to perform a circulation which will be described in detail hereinbefore. A magnetic brush is also formed between the magnetic particle confining pole 14-1 and the confining member 15, which is effective to confine the magnetic particles of the base layer 16 within the container 13.

Above the base layer 16, non-magnetic developer is supplied to form a developer layer 17, so that two layers are formed in the container 13 generally horizontally, i.e., one around the carrying member 12 and the other around the one. The non-magnetic developer supplied may contain a small amount of magnetic particles, but even in that case, the magnetic particle content of the developer layer 17 is smaller than that of the base layer 16. As for the non-magnetic developer, resin kneaded with pigment or dye are pulverized or encapsulated. To the non-magnetic developer particles, silica particles for enhancing the flowability and/or abrasive particles for effectively abrading the surface of the photosensitive member 3 may be added.

The formation of the two layers is not limited to this manner, i.e., two materials are supplied separately, but may be made, for example, by supplying a uniform mixture of the magnetic particles and non-magnetic developer containing a sufficient amount of respective materials for the entire base layer 16 and developer layer 17, and then vibrating the container 13 to form the two layers, using the magnetic field of the magnet 14 and the difference in the specific gravity between the two materials.

It is practicable that the two layers are not specifically formed, and a substantially uniform mixture of the magnetic particles and non-magnetic developer is simply supplied, if a sufficient amount of magnetic particles are contained to form the magnetic brush. However, for long term and stable formation of the magnetic brush, the positive formation of the two layers is preferable.

After the two layers are formed as described above, carrying member 12 is rotated. The magnetic particles are circulated by the magnetic field provided by the magnetic pole and the gravity, as shown by arrow c in FIG. 11. More particularly, in the neighbourhood of the surface of the carrying member 12 near the bottom of the container 13, the magnetic particles move upwardly along the surface of the carrying member 12 by the cooperation of the magnetic field of the magnet 14 and the rotation of the carrying member 12. During this movement, the non-magnetic developer contacts the carrying member 12 surface so that the non-magnetic developer in the base layer 16 is coated on the carrying member 12 surface electrostatically.

In this embodiment of the present invention, the non-magnetic developer is triboelectrically charged by the contact with the magnetic particles and with the carrying member 12. Preferably, however, the triboelectric charge with the magnetic particles is reduced by treating the surface of the magnetic particles with an insulating material, such as oxide coating and a resin having the same electrostatic level as the non-magnetic developer, so that the necessary charging is effected by the contact with the carrying member 12 surface. Then, the deterioration of the magnetic particles is prevented, and simultaneously, the non-magnetic developer is stably coated on the carrying member 12.

The magnetic particles are moved upwardly too by the rotation of the carrying member 12, but prevented from passing through the clearance between the tip of the confining member 15 and the carrying member 12 by the magnetic field formed between the confining member 15 and magnetic particle confining pole 14-1. The magnetic particles behind the confining member 15 are urged by the magnetic particles fed continuously from the bottom of the container 13, and turn, as shown in FIG. 11 by arrow c, whereafter they slowly move down under gravity. During this downward movement, the magnetic particles take the non-magnetic developer among themselves from the lower part of the developer layer 17. Then, the magnetic particles return to the bottom part the container 13, and then move upwardly again by the cooperation of the ladling pole 14-2 and the rotation of the carrying member 12. Those actions are repeated.

On the other hand, the triboelectrically charged non-magnetic developer particles, which are non-magnetic, are not limited by the magnetic field existing in the clearance between the tip of the confining member 15 and the surface of the carrying member 12, so that they are allowed to pass there, and they are coated as a thin layer of uniform thickness on the carrying member 12 by the magnetic brush formed at the confining member 15 and by the image force. The thin layer of the non-magnetic developer is conveyed out of the container 13, and moved to the developing station where the thin layer is opposed to the photosensitive member 3 to develop the image thereon.

The movement of the magnetic particles on the carrying member 12, which depends on the width of the magnetic particle confining pole 14-1, will be described.

FIGS. 12 and 13 show distributions of the magnetic flux density on polar coordinates with its origin representing the rotational axis of the carrying member 12. The magnetic particle confining pole 14-1 is placed on the vertical line of the coordinates. In FIG. 12, the half-peak width of the magnetic flux density is 30 degrees, while in FIG. 13, the half-peak width is maintained 30 degrees, but there is an additional magnetic pole between magnetic particle confining pole 14-1 and magnetic particle ladling pole 14-2. In the FIG. 12 arrangement of the magnetic pole and the half-peak width, the magnetic brush formed by the magnetic particle confining pole 14-1 and the magnetic brush by the magnetic particle ladling pole 14-2 are separated so that the magnetic particles are retained by the respective magnetic poles, resulting in poor circulation. Therefore, it is difficult to take from the developer layer 17 a sufficient amount of the non-magnetic developer into among the magnetic particles, so that the density of the developed image becomes lower with use.

If an additional magnetic pole 14-3 is added as shown in FIG. 13, the magnetic particle conveying action is too strong when the half-peak width is in the order of 30 degrees. This is because the magnetic flux density steeply changes around the carrying member 12 surface so that the conveying power is so strong that the magnetic particles retained on the carrying member 12 by the magnetic particle ladling pole 14-2 is too rapidly moved to make the magnetic brush take too much developer in itself. Then, the coating of the non-magnetic developer on the carrying member 12 is not stable. Additionally, the chance of the developer particle contacting the surface of the carrying member 12 is relatively less, resulting in insufficient triboelectric charging. These lead to non-uniform density of the resultant developed image and a foggy image. In addition, the magnetic particle confining power of the magnetic particle confining pole 14-1 is relatively lowered so that the magnetic particles can leak out on the carrying member 12.

FIG. 14 shows the arrangement wherein the half-peak width of the magnetic particle confining pole 14-1 is made larger to be 50 degrees to 120 degrees so that the distribution of the magnetic flux density is wider. With this arrangement, the movement of the magnetic particles is properly constrained so that a moderate circulation is provided. Not too much developer is taken by the magnetic brush, and a thin layer of non-magnetic developer of uniform thickness and with sufficient triboelectric charge is formed on the carrying member 12. Additionally, since the movement of the magnetic particles is not fierce, the magnetic particle confining pole 14-1 can be sure to confine the magnetic particles, whereby the magnetic particles do not easily leak out under the tip of the confining member 15. Particulaly, when the half-peak width of approx. 90 degrees is selected, good images can be provided without non-uniform density, fog or too low density. When the half-peak width of the magnetic particle confining pole 14-1 is larger than 120 degrees, the circulation of the magnetic particles is too weak, with the result that the supply of the developer is not enough so as to cause low density.

Next, the magnitude of the magnetic field will be described. When the magnetic field by the magnetic particle confining pole 14-1 is less than 300 G, the magnetic particle confining power is so weak that the magnetic particles leak out of the container 13 on the carrying member 12 to reach the developing station. If, on the contrary, it is larger than 800 G, the magnetic particles are too strongly retained, that is, in press-contacted state, onto the carrying member 12. Therefore, the non-magnetic developer layer formed on the carrying member 12 has a stripe pattern, resulting in poor quality images. In view of these considerations, the magnetic particle confining pole 14-1 is preferably of 300 G to 800 G, more preferably, 500 G to 600 G.

As described above, this embodiment of the present invention is advantageous, since the magnetic particle confining pole 14-1 provides the magnetic field of a large half-peak width, proper circulation as well as positive and proper taking of the non-magnetic developer are assured. Also, the possibility of leakage of the magnetic particles is minimized. Thus, good formation of developed images are provided.

The developing system to be used here is preferably the non-contact type development disclosed in U.S. Pat. No. 4,395,476, although conventional contact type development is usable. Between the photosensitive member 3 and the carrying member 12, a voltage is applied by a bias voltage source 19 which is of AC, DC or preferably an AC superposed with a DC.

A detailed example of the above embodiment of the present invention will be described.

The example was constructed according to the FIG. 11 embodiment, wherein photosensitive member 3 was rotated in the directon of arrow a at the peripheral speed of 60 mm/sec. The carrying member 12 of stainless steel (SUS 304) having the outer diameter 32 mm and the thickness 0.8 mm was rotated at the peripheral speed of 66 mm/sec in the direction of arrow b. The surface of the sleeve was treated by irregular sand-blasting to provide the surface roughness, in the circumferential direction, of 0.8 micron (RZ=0.8S).

Within the carrying member 12, magnet 14 of ferrite cintering type was fixed in such a position that the magnetic particle confining pole 14-1(N) was 30 degrees away from the line connecting the center of the carrying member 12 and the tip of the confining member 15. The half-peak width was set to be 90 degrees as viewed from the center of the carrying member 12, as shown in FIG. 15. The magnetic particle ladling pole 14-2(S) was opposed to the iron piece 32, which was magnetic, mounted on the inside of the carrying member 12 wall adjacent the developer returning side of the carrying member 12. The magnetic flux density of the magnetic particle ladling pole 14-2 at the surface of the carrying member 12 was 650 G(peak) in the presence of the iron piece 32, and 400 G in the absence of the iron piece 32. The iron piece was spaced apart from the carrying member 12 by 1.0 mm and it was faced to the carrying member 12 over the width of 0.5 mm.

The confining member 15 was made of steel and plated with nickel for rust prevention. The tip thereof was spaced apart by 100 microns from the surface of carrying member 12.

As for the magnetic particles, 100 g of spherical ferrite (Tokyo Denkikagaku Kogyo Kabusiki Kaisha, Japan) was used. For the non-magnetic developer, 200 g of cyan color powder provided by 100 parts of polyester resin incorporated by 3 parts of copper phthalocyanine pigments and 5 parts of negative charge controlling agent (alkylsalicylic acid metal complex) and added by silica 0.5%, was used. It was negatively chargeable and 12 microns ave. diameter. The non-magnetic developer and the magnetic particles were mixed, and supplied into the container 13. It has been observed, when the amount of the remaining non-magnetic developer becomes small, that the mixture, inter alia, the magnetic particles are circulated during rotation of the carrying member 12.

With the rotation of the carrying member 12, a thin layer of 60 microns thickness consisting only of the non-magnetic developer was formed on the carrying member 12. The charge of the thin layer was measured by blow-off method, and it was confirmed that the thin layer was uniformly charged to 7 micro coulomb/g.

The thin layer of the non-magnetic developer obtained by the above structure was opposed to a photosensitive member 3 bearing an electrostatic latent image of +600 V at the dark area and +150 V at the light area with the clearance of 300 microns to the surface of the photosensitive member 3. The bias voltage of 800 Hz and peak-to-peak voltage of 1.4 KV with central value of +300 V was applied by the bias source 19. A PC-20 copying machine(Canon Kabushiki Kaisha, Japan) was used, and good resultant images without ghost or fog were obtained.

The magnetic particles were hardly consumed, and only the non-magnetic developer was consumed for the development. The developing function was constant until most of it was consumed.

In the foregoing example, N pole was used for the magnetic particle confining pole 14-1, but it may be S pole.

In the example described above, the confining member 15 was of a magnetic material, such as steel. However, a non-magnetic confining member 15 made of a non-magnetic material such as aluminium, copper and resin may be usable. Also, the wall of the container 13, if it is made of a non-magnetic material, may be used as the confining member 15. In this case, the clearance between the tip of the carrying member 12 and the surface of the carrying member 12 is needed to be smaller than the clearance when the magnetic confining member 15 is used. The magnetic confining member 15 is preferable in that a stabilized magnetic brush is formed at the developer outlet by the magnetic field between the confining member 15 and the magnetic pole.

As described above, according to the embodiment of FIGS. 11 to 15, an apparatus is provided wherein the magnetic particles confined by the magnetic field is used for forming a thin layer of non-magnetic developer on the carrying member 12, and wherein the circulation of the magnetic particles is positively established, which is not too strong, so that proper circulation is assured and that the possibility of magnetic particle leakage is minimized, thus achieving a desired development operation.

When the magnetic particles do not circulate sufficiently within the container 13, the triboelectric charge to the developer is not enough, resulting in insufficient coating on the developer carrying member 12. This can lead to foggy images when the developing apparatus is operated.

The next embodiment is intended to make the circulation of the magnetic particles smoother and ensure the supply of the developer to the base layer 16.

FIG. 16 is a cross-sectional view of the non-magnetic developer thin layer forming apparatus and method and developing apparatus and method according to this embodiment. Since this embodiment is similar to the embodiment described with FIGS. 1, 2, 5, 7 and 11, except for the portions which will be described, the detailed description of the similar portion is omitted for the sake of simplicity by assigning the same reference numerals to the elements having corresponding functions.

As shown in FIG. 16, a rear wall 13-1 is provided near the bottom of the container 13. The rear wall 13-1 is effective to assure the presence of the magnetic particles in the lower portion of the container 13 and also to improve the circulation of the magnetic particles, which will be described in detail hereinafter.

On a part of the inside wall of the container 13, which is opposed to a sealing pole 14-2 an iron piece 32 is secured, which may be another metal or a magnet having the magnetic pole of the polarity opposite to that of the sealing pole 14-2. A magnetic brush is formed therebetween to seal the bottom of the container 13 and also to improve the circulation of the magnetic particles. In place of using a separate member attached to the wall of the container 13 as the above piece, the same effect may be provided by simply approaching the part of the container 13 wall toward the carrying member 12 at the portion opposed to the sealing pole 14-2, when the container 13 wall is made of a magnetic material such as a steel.

In operation, the magnetic particles are moved upwardly by the rotation of the carrying member 12, but prevented from passing through the clearance between the tip of the confining member 15 and the carrying member 12 by the magnetic field formed between the confining member 15 and magnetic particle confining pole 14-1. The magnetic particles behind the confining member 15 are urged by the magnetic particles continuously fed from the bottom of the container 13, and turn, as shown in FIG. 11 by arrow c, whereafter they slowly move down under gravity. During this downward movement, the magnetic particles take the non-magnetic developer among themselves from the lower part of the developer layer 17. Then, the magnetic particles returns to the bottom part the container 13. Those actions are repeated.

The confining member 15 is inclined toward the inside of the container 13 in the upward direction, that is, with the distance from the tip of the confining member 15. Therefore, the magnetic particles around the confining member 15 show the movement more in dependence on the gravity so that the magnetic particles fall smoothly. Also, this inclination is effective to relieve the magnetic brush adjacent the confining member 15 from the pressure which may otherwise be imparted thereto by the non-magnetic developer thereabove. Further, the height of the magnetic brush is small, so that the pressure given by the magnetic particles is low too. These are effective to minimize the possibility of the magnetic particles passing through the clearance between the tip of the confining member 15 and the surface of the carrying member 12. With the increase of the inclination, the circulation becomes better, and the prevention of magnetic particle leakage is stronger.

The rear wall 13-1 is provided adjacent to the bottom of the container 13 in such a manner that the horizontal distance between the carrying member 12 surface and the inside surface of the rear wall 13-1 is increased in the downstream direction with respect to movement of the carrying member 12, i.e., with the distance from the bottom of the container 13. In other words, the rear wall 13-1 is inclined in the same direction as the confining member 15. By this, the presence of the magnetic particles near the sealing pole 14-2 is assured, so that the developer layer 17 does not come to contact to the surface of the carrying member 12 even with long term use. Also, by this the sealing action here is assured.

FIG. 17 shows another embodiment of the present invention. Since this embodiment is similar to the foregoing embodiment, except for the portions which will be described, the detailed description of the similar portions is omitted for the sake of simplicity by assigning the same reference numerals to the elements having corresponding functions. In this embodiment, a stirring means 33 is provided adjacent to the interface between the base layer 16 and the developer layer 17 and adjacent to the position to which the developer falls. The stirring means 33 comprises a driving rotational shaft 34 and stirring member 36 which is secured to the driving shaft 34 by supporting members 35 and which extends in the direction parpendicular to the sheet of the drawing. The stirring member is rotated in the direction of arrow c through the driving shaft 34 which is driven by an unshown driving mechanism. The stirring member extends as far as near the opposite ends of the container 13 so that the stirring action is assured at the ends. The stirring by the stirring means 33 is effective to promote the circulation of the magnetic particles of the base layer 16 and to take the non-magnetic developer thereabove and supply it to the base layer 16. Thus, the supply of the non-magnetic developer is assured. The stirring means 33 is spaced apart from the carrying member 12 by the distance of not less than 4 mm, preferably approx. 10 mm. If the stirring means is closer, an excessive amount of the developer is supplied to the carrying member 12, resulting in insufficient triboelectric charge to the non-magnetic developer which leads to foggy images after developmet.

FIG. 18 shows the arrangement wherein the stirring means 33 does not contact the magnetic particles of the base layer 16 at all. The stirring means is kept from contacting the magnetic particles in the base layer 16 over the entire phase of the stirring action. It is entirely emmersed in the non-magnetic developer. In this arrangement, the stirring means does not provide the promotion of the circulation nor the promotion of the non-magnetic developer taking. Particularly, the density decrease at the ends results.

When, on the other hand, the stirring means is completely emmersed in the base layer 16, the circulation is not good, and there is a tendency of insufficient supply of the non-magnetic developer, particuarly when, for example, the magnetic particles coated with fluorine resin are used. Therefore, the low density of the resultant image and localized void of the developed image may easily result. For this reason, it is preferable to locate the stirring means at the interface between the developer layer 17 of non-magnetic developer and the base layer 16 of the magnetic particles.

The rotational speed of the stirring means is preferably such that the ratio to the rotational speed of the carrying member 12 is 2:1 to 1:100, more preferably, 1:1 to 1:50. In this embodiment, the rotational speed of the stirring means is set to be $\frac{1}{2}$ rot./sec when that of the carrying member 12 is 1 rot./sec, with satisfactory results not showing fog or localized void.

In this embodiment, the stirring means is described as located adjacent the bottom of the container 13, but it may be located adjacent to the confining member 15. FIG. 20 shows this arrangement. Since this embodiment is similar to the foregoing embodiment, except for the stirring means, the detailed description of the other parts is omitted for the sake of simplicity by assigning the same reference numerals to the elements having corresponding functions.

The stirring means 36 is so located as to be spaced away from the carrying member 12 by not less than 8 mm. It is swingably mounted on the driving shaft. The swinging action stirs the magnetic particles which are coming up along the back(inside) face of the confining member 15, and promote them to move downwardly. At this time, the magnetic particles at the topmost of the base layer 16 is removed so that the weight imparted to the lower magnetic particles is reduced to promote the upward movement thereof adjacent the confining member 15. Thus, the circulation of the magnetic particles are as a whole improved. Also, the stirred magnetic particles take the adjacent non-magnetic developer efficiently, so that the non-magnetic developer is sufficiently taken into among the magnetic particles.

The stirring means in FIG. 17 is the rotational one, whereas that in FIG. 18 is the swingable one. This may be reversed. Also, two of the stirring means 33 are used adjacent to the confining member 15 and the bottom of the container 13, respectively.

When the devices according to the foregoing embodiments were actually operated, good images are formed with constant density irrespective of the ratio of the non-magnetic developer to the magnetic particles. And, it has been confirmed that the device is relatively insensitive to the change of ambient conditions.

In the example described above, the confining member 15 has been explained as of a magnetic material, such as steel. However, a non-magnetic confining member 15 made may be of a non-magnetic material such as aluminium, copper and resin. Also, the wall of the container 13, if it is made of a non-magnetic material, may be used as the confining member 15. In this case, the clearance between the tip of the confining member 15 and the surface of the carrying member 12 is needed to be smaller than the clearance when the magnetic confining member 15 is used. The magnetic confining member 15 is preferable in that a stabilized magnetic brush is formed at the developer outlet by the magnetic field between the confining member 15 and the magnetic pole.

As described above, the embodiments shown in FIGS. 16 to 20 provide the apparatus wherein the non-magnetic developer is taken into among the magnetic particles to a sufficient extent, and wherein the triboelectric charge to the non-magnetic developer is also sufficient.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing a latent image on an image bearing member, comprising:

a container having an opening adjacent a lower part thereof;

a developer carrying member movable along an endless path and between an inside of said container and an outside of said container;

magnetic field generating means, disposed in said developer carrying member, for generating a magnetic field;

a partition member in said container for separately supporting, before operating said developing apparatus, a first developer which is to form in operation a circulating base layer in said container and on a surface of said developer carrying member, and a second developer which is to be supplied into the base layer from a surface of said base layer, said first developer mainly including magnetic particles, and said second developer mainly including non-magnetic toner particles, wherein by retracting said partition member, the base layer of the first developer is formed on said developer carrying member, and then the second developer is formed on the surface of the base layer; and a regulating member having an end portion cooperable with said magnetic field generating means to regulate an amount of the non-magnetic developer applied on said developer carrying member from said container, wherein when said developer carrying member moves, a circulation is formed in said base layer, including upward flow mainly of the magnetic particles substantially along the surface of said developer carrying member and including downward flow by gravity above a portion of the upward flow and in the neighborhood of said regulating member, whereby the non-magnetic developer in the second developer is taken into the base layer, and the non-magnetic developer is charged and applied onto the surface of said developer carrying member.

2. An apparatus according to claim 1, wherein said magnetic field generating means is stationary and has a magnetic pole adjacent said regulating member, and the magnetic pole is disposed upstream of said regulating member with respect to the movement direction of said developer carrying member.

3. An apparatus according to claim 2, wherein said magnetic pole is deviated by 5°–50° from the end portion of said regulating member as seen from a center of the endless path of said developer carrying member.

4. An apparatus according to claim 3, wherein said regulating member is of non-magnetic material.

5. An apparatus according to claim 3, wherein said regulating member is of magnetic material and forms a magnetic field between the magnetic pole and itself to confine the magnetic particles within said oontainer.

6. An apparatus according to claim 1, further comprising magnetic sealing means, mounted to said container adjacent a portion where said developer carrying member moves back into said container, cooperable with a stationary magnetic pole of said magnetic field generating means to confine the magnetic particles within said container by a magnetic field formed therebetween so as to prevent the magnetic particles from leaking therefrom wherein the base layer is formed over the surface of said developer carrying member from a neighborhood of said regulating member to a neighborhood of said magnetic sealing means.

7. An apparatus according to claim 6, wherein said regulating member is magnetic, and said magnetic field generating means includes a plurality of magnetic poles, and wherein said regulating member is disposed downstream of a magnetic pole, which is closest thereto, with respect to the movement direction of said developer carrying member.

8. An apparatus according to any one of claims 1–7, wherein said regulating member includes a portion inclined toward the inside of said container, said inclined portion being effective to reverse the movement direction of the magnetic particles.

9. An apparatus according to claim 1, further comprising stirring means disposed at an interface between the base layer and the second developer.

10. An apparatus according to claim 6, further comprising means for moving the magnetic particles from an inside part of said container to said sealing means to enhance the sealing effect thereof.

11. An apparatus according to claim 1, wherein the magnetic particles are substantially spherical in shape and have substantially insulative surfaces.

12. An apparatus according to claim 1, further comprising stirring means within said container.

13. An apparatus according to claim 12, wherein said stirring means stirs the interface between the base layer and the developer layer.

14. An apparatus according to claim 12, wherein said stirring means is rotatable.

15. An apparatus according to claim 12, wherein said stirring means is swingable.

16. An apparatus according to claim 12, wherein said stirring means is provided adjacent upper and/or lower portion of said container.

17. An apparatus according to claim 1, wherein said regulating member includes a blade inclined toward upstream in the upward direction.

18. An apparatus according to claim 1, wherein said developer carrying member has a rough surface.

19. A developing apparatus for developing a latent image on an image bearing member, comprising:

a first container for containing mainly non-magnetic developer and having an opening;

a second container for containing mainly magnetic particles and having an opening;

sealing means for sealing the opening of said first container and sealing the opening of said second container, said sealing means preventing the opening of said first container from being unsealed before the opening of said second container is unsealed;

a third container communicable with the openings of said first and second containers, said third container having an opening adjacent a lower part thereof;

a developer carrying member movable along an endless path and between an inside of said container and an outside of said container;

magnetic field generating means, disposed in said developer carrying member, for generating a magnetic field; and means for regulating an amount of non-magnetic developer applied to said developer carrying member;

wherein said sealing means allows the opening of said first container to be unsealed only after the opening of said second container is unsealed whereby a base layer mainly including the magnetic particles is formed on said developer carrying member in said third container, and only then is the non-magnetic developer supplied.

20. An apparatus according to claim 19, wherein said magnetic field generating means includes a stationary magnet, and said regulating means includes a regulating member having an end portion adjacent to said developer carrying member, wherein said stationary magnet includes a magnetic pole at a position corresponding to an inside of said third container, and the end portion of said regulating member is disposed downstream of said magnetic pole with respect to the movement direction of said developer carrying member.

21. An apparatus according to claim 20, wherein the end portion is of magnetic material, and a magnetic field is formed between the magnetic pole and itself to confine the magnetic particles within said third container.

22. An apparatus according to claim 20, wherein said end portion is of non-magnetic material to regulate the non-magnetic toner particles and magnetic particles conveyed toward itself on said developer carrying member.

23. An apparatus according to claim 20, further comprising means for preventing the magnetic particles from leaking out of said third container adjacent a position where said developer carrying member moves back into said third container.

24. An apparatus according to claim 23, wherein said preventing means includes a magnetic member for forming a magnetic field between itself and another magnetic pole of said fixed magnetic, whereby a magnetic field is formed between said magnetic member and said another magnetic pole to prevent the magnetic particles from leaking.

25. An apparatus according to any one of claim 19–24, wherein said developer carrying member extends from a lower portion of said third container to an upper portion thereof, wherein a circulation of the magnetic particles is formed in the base layer in which the magnetic particles move up along the developer carrying member to a neighborhood of said regulating meand and then move down by gravity, whereby the non-magnetic developer is taken into the base layer.

26. An apparatus according to claim 20, wherein said magnetic pole provides a half-peak width of 50–120 degrees, as viewed from a rotational axis of said developer carrying member.

27. An apparatus according to claim 26, wherein said magnetic pole provides said magnetic pole 300–800 G on the surface of said developer carrying member.

28. An apparatus according to claim 19, wherein said first, second and third containers form a developer supply container.

29. An apparatus according to claim 28, wherein said first container is located above said second container.

30. An apparatus according to claim 28 or 29, wherein said partition means includes a first partition plate at the bottom of said second container, and a second partition plate at the bottom of said first container.

31. An apparatus according to claim 13, wherein said stirring means and developer carrying member rotate at a speed ratio of between 2:1–1:100.

32. An apparatus according to claim 31, wherein said stirring means is spaced apart from said developer carrying member by not less than 4 mm. and adjacent said regulating member.

33. An apparatus according to claim 25, wherein said regulating member includes a portion inclined toward inside of said container, said inclined portion being effective to reverse the movement direction of the magnetic particles.

34. An apparatus according to any one of claim 1–7, further comprising means for applying an AC bias between said developer carrying member and the latent image bearing member.

35. An apparatus according to claim 30, wherein said first partition plate and the second partition plate are formed by a single sheet.

36. An apparatus according to claim 35, wherein said sheet is folded to provide a two layer structure.

37. An apparatus according to claim 28, wherein said second container contains magnetic particles mixed with 5–70 wt. %, to the magnetic particles of the non-magnetic developer.

38. An apparatus according to claim 28, wherein said first container contains the developer mixed with a small amount of magnetic particles.

39. An apparatus according to claim 28, wherein said first container is of a cartridge type.

40. An apparatus according to claim 23, wherein a bias voltage is applied between said developer carrying member and a member to be developed.

41. An apparatus according to claim 40, wherein said bias is an AC bias.

42. An apparatus according to claim 41, wherein said AC bias is superposed with DC.

* * * * *

UNITED STATES PATENT AND TRADEMARK OFFICE

CERTIFICATE OF CORRECTION

PATENT NO. : 4,607,938

DATED : August 26, 1986

INVENTOR(S) : ATSUSHI HOSOI, ET AL.

It is certified that error appears in the above-identified patent and that said Letters Patent is hereby corrected as shown below:

COLUMN 1

Line 31, "on" should read --of--.

COLUMN 2

Line 21, "DRAWINNGS" should read --DRAWINGS--.

COLUMN 3

Line 12, "EMBODIMENT" should read --EMBODIMENTS--.
Line 13, "preffered" should read --preferred--.
Line 44, "by a" should read --by--.

COLUMN 4

Line 7, "only" should be deleted(second occurence).

COLUMN 5

Line 3, "memb 12." should read --member 12.--

COLUMN 6

Line 28, "later" should read --layer--.
Line 47, "density" should read -- density and no--.

COLUMN 7

Line 29, "parpendicular" should read --perpendicular--.

COLUMN 8

Line 56, "particle" should read --particles--.

UNITED STATES PATENT AND TRADEMARK OFFICE

CERTIFICATE OF CORRECTION

PATENT NO. : 4,607,938

DATED : August 26, 1986

INVENTOR(S) : ATSUSHI HOSOI, ET AL.

It is certified that error appears in the above-identified patent and that said Letters Patent is hereby corrected as shown below:

COLUMN 10

Line 3-4, "as shown in FIG. 8, but a non-magnetic blade may be used." should read --, but a non-magnetic blade may be used as shown in FIG. 8.--.
Line 18, "boned" should read --bonded--.
Line 61, "exchageable" should read --exchangeable--.
Line 64, "the the" should read --the--.
Line 68, "falls so that" should read --falls,--.

COLUMN 11

Line 19, " in," should read --in--.
Line 45, "a steel, or" should read --steel, or a--.
Line 57, "particle" should read --particles--.

COLUMN 14

Line 62, "cintering" should read --sintering--.

COLUMN 15

Line 16, "Kabusiki" should read --Kabushiki--.

COLUMN 16

Line 64, "returns" should read --return--.

COLUMN 17

Line 42, "parpendicular" should read --perpendicular--.
Line 60, "developmet." should read --development.--.
Line 66, "emmersed" should read --immersed--.

UNITED STATES PATENT AND TRADEMARK OFFICE

CERTIFICATE OF CORRECTION

PATENT NO. : 4,607,938

DATED : August 26, 1986

INVENTOR(S) : ATSUSHI HOSOI, ET AL.

It is certified that error appears in the above-identified patent and that said Letters Patent is hereby corrected as shown below:

COLUMN 18

Line 4, "emmersed" should read --immersed--.
Line 37, "is" should read --are--.
Line 41, "are" should read --is--.

COLUMN 20

Line 13, "therefrom wherein" should read --therefrom, wherein--.

COLUMN 21

Line 16 "unsealed whereby" should read --unsealed, whereby--.
Line 48, "magnetic" , second occurrence, should read -- magnet --.

UNITED STATES PATENT AND TRADEMARK OFFICE

CERTIFICATE OF CORRECTION

PATENT NO. : 4,607,938

DATED : August 26, 1986 Page 4 of 4

INVENTOR(S) : ATSUSHI HOSOI, ET AL.

It is certified that error appears in the above-identified patent and that said Letters Patent is hereby corrected as shown below:

COLUMN 22

Line 1, "meand" should read --means--.
Line 50, "23" should read --25--.

Signed and Sealed this

Seventeenth Day of March, 1987

*Attest:*

DONALD J. QUIGG

*Attesting Officer* *Commissioner of Patents and Trademarks*